US005978917A

United States Patent [19]

Chi

[11] Patent Number: 5,978,917

[45] Date of Patent: Nov. 2, 1999

[54] DETECTION AND ELIMINATION OF MACRO VIRUSES

[75] Inventor: Darren Chi, Alhambra, Calif.

[73] Assignee: Symantec Corporation, Cupertino, Calif.

[21] Appl. No.: 08/911,298

[22] Filed: Aug. 14, 1997

[51] Int. Cl.[6] ..... G06F 12/14

[52] U.S. Cl. ..... 713/201; 713/200; 380/3; 380/4

[58] Field of Search ..... 395/187.01, 186; 380/3, 4; 713/201, 200

[56] References Cited

U.S. PATENT DOCUMENTS

| | | | |
|---|---|---|---|
| 5,398,196 | 3/1995 | Chambers | 395/183.04 |
| 5,832,208 | 11/1998 | Chen et al. | 395/186 |
| 5,854,916 | 12/1998 | Nachenberg | 395/500 |

FOREIGN PATENT DOCUMENTS

| | | | |
|---|---|---|---|
| WO 95/33237 | 12/1995 | WIPO | G06F 11/00 |

OTHER PUBLICATIONS

To LOOK Software System Inc. is cited for "Virus Alert for Macros" 1997.

Bontchev, Vesselin, "Possible macro virus attacks and how to prevent them", *Computers & Security*, vol. 15, No. 7, pp. 595–626, 1996, United Kingdom.

*Primary Examiner*—Robert W. Beausoliel, Jr.
*Assistant Examiner*—Wasseem Hamdan
*Attorney, Agent, or Firm*—Fenwick & West LLP

[57] ABSTRACT

Apparatus and method for detecting the presence of macro viruses within a digital computer (1). An application program (5) is associated with the digital computer (1). A global environment (13) is associated with the application program (5). The application program (5) generates at least one local document (11). Macros contained within the global environment (13) and the local document(s) (11) are executed in a simulated manner by an emulator (15). At least one preselected decision criterion is used by a detection module (17) to declare when a macro virus is deemed to be present. Such a criterion is typically the presence of a bidirectional macro, i.e., a macro that copies from a local document (11) to the global environment (13) and vice-versa. Macros deemed to be viruses are preferably deleted by a repair module (19). Additional deletion criteria may include the presence of macros that have the same source name or the same destination name as a bidirectional macro. In the preferred emulation steps, emulator (15) tests all of the macros associated with computer (1) in two steps. The first step assumes that the macros reside within the global environment (13), regardless of whether they reside within the global environment (13) or within a local document (11). The second step assumes that the macros reside within a local document (11), regardless of whether they reside within a local document (11) or within the global environment (13).

12 Claims, 5 Drawing Sheets

DETECTION AND ELIMINATION OF MACRO VIRUSES

TECHNICAL FIELD

This invention pertains to the field of detecting and eliminating computer viruses of a particular class known as macro viruses.

BACKGROUND ART

U.S. Pat. No. 5,398,196 discusses the detection of viruses within a personal computer. However, unlike the present invention, this reference does not treat the elimination of detected viruses, nor does it discuss macro viruses.

Existing technology used by anti-virus programs to detect and repair macro viruses requires, for each unique new macro virus, the development of a detection and repair definition. After the development of the detection and repair definition, the anti-virus program must be augmented with the new definition before it can detect the newly discovered macro virus. This method has the advantage that a skilled anti-virus researcher is able to study the virus and understand it enough so that a proper detection and repair definition can be created for it. The main disadvantage is that a relatively long turnaround time is required before the general public is updated with each new definition. The turnaround time includes the duration during which the virus has a chance to spread and possibly wreak havoc, the time to properly gather a sample and send it to an anti-virus research center, the time required to develop the definition, and the time to distribute the definition to the general public. This process is similar to the process used for protecting against the once more prevalent DOS viruses.

One species of existing technology uses rudimentary heuristics that can scan for newly developed macro viruses . These heuristics employ expert knowledge of the types of viruses they seek. Often these heuristics look for strings of bytes that are indicative of viral behavior, for example, strings found in currently known viruses. Current heuristics are very good at detecting new viruses that are variants of known viruses with a high level of confidence. The main disadvantage of current heuristics is that they are good enough for detection only. This is true of both macro virus heuristics and DOS virus heuristics.

DISCLOSURE OF INVENTION

The present invention is an apparatus and method for detecting the presence of macro viruses within a digital computer (1). An application program (5) is associated with said digital computer (1). A global environment (13) is associated with said application program (5). The application program (5) generates at least one local document (11). Macros contained within the global environment (13) and the local document(s) (11) are executed in a simulated manner by an emulator (15). A preselected decision criterion is used by a detection module (17) to determine when a macro virus is present.

BRIEF DESCRIPTION OF THE DRAWINGS

These and other more detailed and specific objects and features of the present invention are more fully disclosed in the following specification, reference being had to the accompanying drawings, in which.

DEFINITIONS

Figure 1:
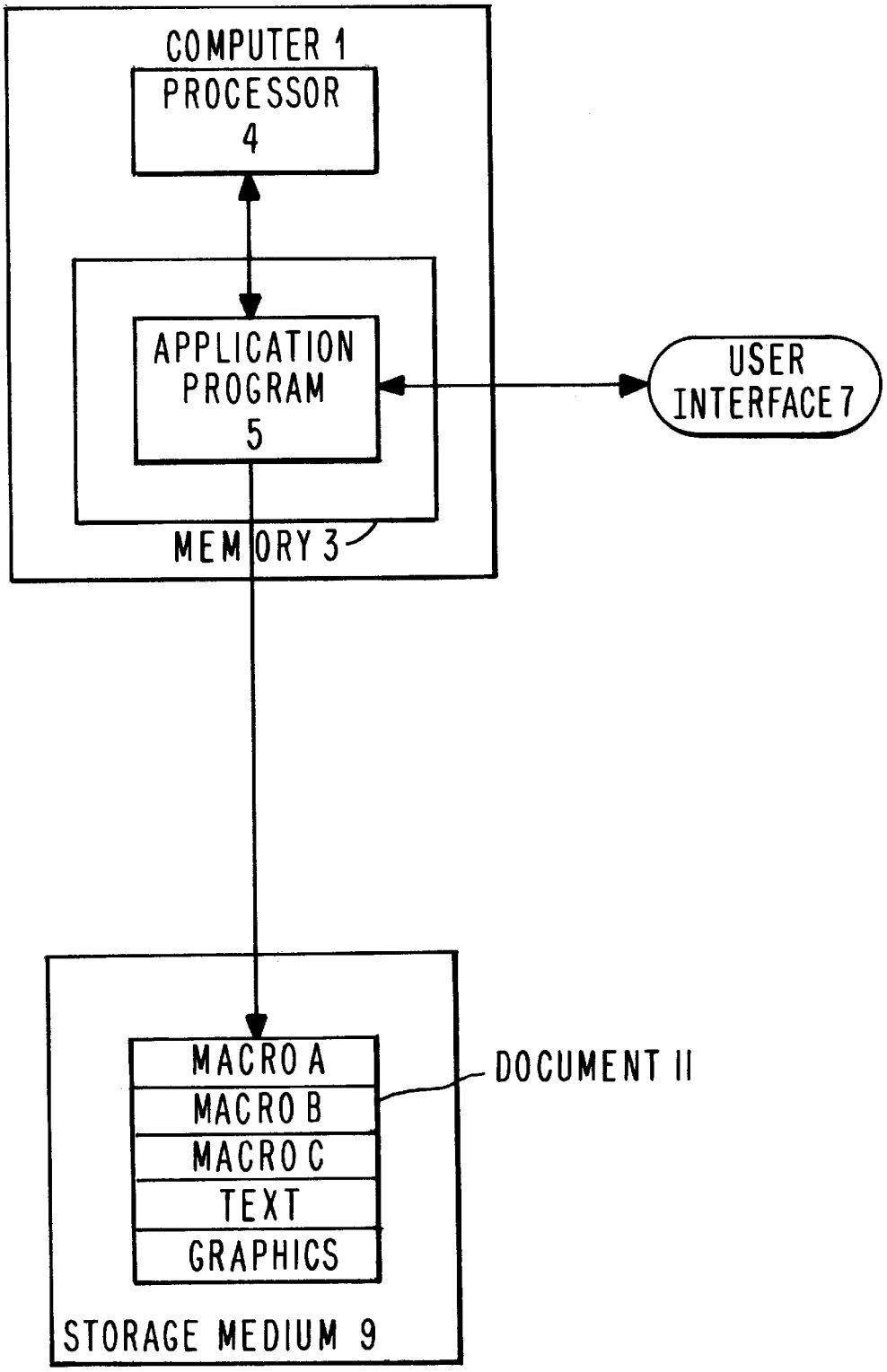
FIG.1 PRIOR ART
FIG. 1 is a block diagram showing the type of application program 5 in the existing art that can be contaminated by macro viruses detectable by the present invention.

As used throughout the present specification and claims, the following words and expressions have the indicated meanings:

"macro" is a computer program written using a structured programming language and created from within an application program that has a global environment and can create local documents. Normally, a macro can be invoked using a simple command such as a keystroke. The application program can be, for example, Microsoft Word or Excel.

"global environment" is an area within a storage medium that is associated with a particular application program and stores parameters and/or macros with said application program. For example, the global environment for a particular application program can contain text, graphics, and one or more macros.

"local document" is a document that has been generated by an application program.

"virus" is a malicious computer program that replicates itself.

"macro virus" is a virus consisting of one or more macros.

"payload" is an unwanted destructive task performed by a virus. For example, the payload can be reformatting a hard disk, placing unwanted messages into each document created by an application program, etc.

"emulation" means running a computer program in a simulated environment rather than in a real environment.

"simulated environment" means that some of the functioning of the computer program is disabled. As an example, in a real environment the computer program writes to a hard disk; but in a simulated environment, the computer program thinks it writes to a hard disk but does not actually do so.

"heuristics" means a set of inexact procedures.

"publicly identified macro virus" means a macro virus that has a known viral signature.

"publicly unidentified macro virus" means a macro virus that can not be identified by anti-virus software using viral signature matching techniques.

DETAILED DESCRIPTION OF THE PREFERRED EMBODIMENTS

The purpose of the present invention is to detect and eliminate macro viruses in a generic manner, i.e., the present invention works regardless of the payload of the virus.

The present invention uses heuristics that can determine effectively whether any given set of macros is a virus or not, and determine exactly the set of macros that comprise the virus. This is achieved through the implementation, by means of an emulator 15, of heuristics that emulate the target macro environment. The behavior of. the macros within the environment is noted by the emulator 15.

The present invention offers the following advantages over the prior art:

- a generic detection and repair solution for new macro viruses with virtually no turnaround time.
- ability to determine with an extremely high degree of confidence that a set of macros flagged as a virus by the heuristic emulator 15 is indeed a virus.
- ability to detect entirely new macro viruses that are not must variants of known viruses.
- ability to determine the set of macros that comprise the virus, thus providing an immediate repair solution.
- reduced workload for all personnel involved in terms of virus discovery, analysis, and definition creation.
- increased user satisfaction with regard to protection against new viruses.

The present invention provides a generic method for identifying the presence of macro viruses and for eliminating those viruses from infected documents. This is achieved through use of heuristic emulation technology. The underlying method is to emulate the execution of macros within an isolated environment. The environment is set up such that it mimics as much as possible the environment within which a macro virus could normally propagate. If, during emulation, the behavior of the macros is such that there is a propagation of macros that mimics the general behavior in which macro viruses propagate, then the tested document 11, 13 is flagged as being infected with a virus.

FIG. 1 illustrates a typical operating environment of the present invention. A digital computer 1 comprises a processor 4 and memory 3. When it is to be executed, application programs moved into memory 3 and is operated upon by processor 4. Application program 5 is any program that generates macros, for example, Microsoft Word or Excel. When it is executed, application program 5 generates one or more local documents 11, which are stored in storage medium or media 9 associated with computer 1. For example, storage medium 9 can be a hard disk, floppy disk, tape, optical disk, or any other storage medium used in connection with digital computers. Each document 11 can comprise text, graphics, and/or one or more macros which, in FIG. 1, are designated macros A, B, and C. A user of computer 1 typically communicates with application program 5 via user interface 7, which may comprise a keyboard, monitor, and/or mouse.

Figure 2:
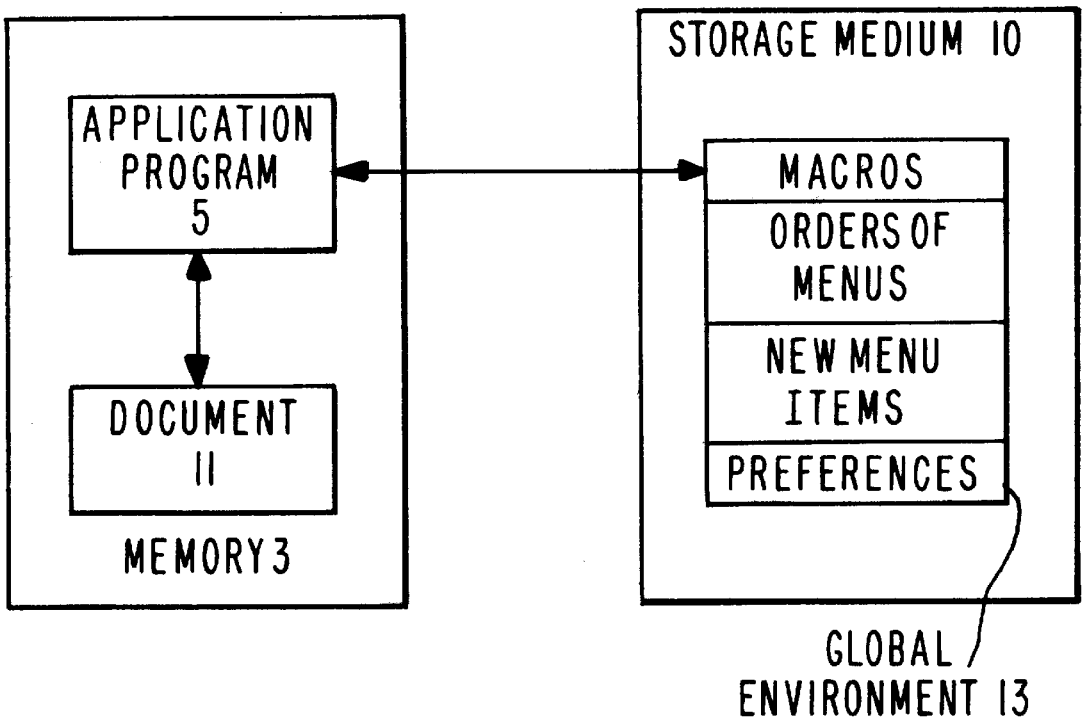
FIG. 2 PRIOR ART
FIG. 2 is a block diagram showing global environment 13 associated with application program 5 of FIG. 1.

FIG. 2 shows a document 11 that has been opened by application program 5. Because document 11 has been so opened, it resides in memory 3, where it can be readily and quickly accessed by application program 5. As stated previously, document 11 can contain one or more macros. If one of these macros is named AutoOpen or a similar name, the macro will execute automatically. Alternatively, the macro could execute upon the user pressing a certain key on keyboard 7, or upon the occurrence of another event.

FIG. 2 also illustrates the presence of the global environment 13 that is associated with application program 5. Global environment 13 is located within storage medium 10. Storage medium 10 can be the same storage medium 9 as used by one or more documents 11 that have been generated by application program 5. Alternatively, storage medium 10 may be distinct from storage medium 9 or storage media 9. Storage medium 10 can be any storage device used in conjunction with a digital computer, such as a hard disk, floppy disk, tape, optical disk, etc.

If application program 5 is Microsoft Word, then global environment 13 is typically named normal.dot.

Global environment 13 is available to the user every time the or she uses application program 5, and is specific to each such application program 5.

Global environment 13 typically contains a set of macros established by the user previously, orders of menus, new menu items, and preferences of the user, e.g., font styles and sizes.

Figure 3:
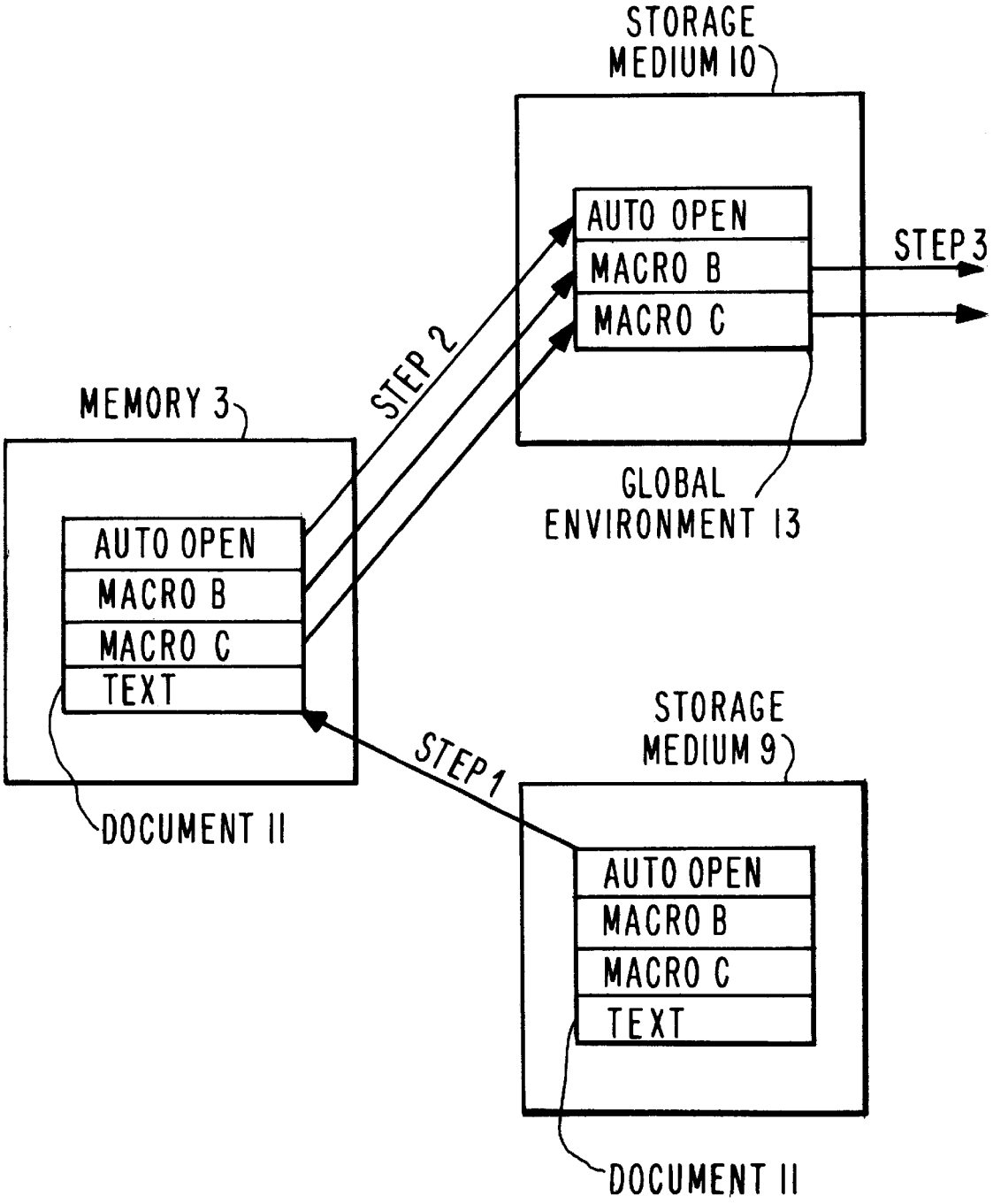
FIG.3 PRIOR ART
FIG. 3 is a block diagram showing how a macro virus can contaminate the computing environment illustrated in FIGS. 1 and 2.

FIG. 3 illustrates how macro viruses propagate (replicate) into the global environment 13. In step 1, document 11 is opened by application program 5. During step 1, document 11, including all the elements contained therewithin, move from storage medium 9 to memory 3. In the illustrated embodiment, document 11 comprises a first macro named AutoOpen, a second macro named macro 2, a third macro named macro C, and some text. Let us assume that all three macros are part of a macro virus. The text may be, for example, a letter that the user has created previously. All of these items move to memory 3. Since AutoOpen is a macro that executes automatically, in step 2 AutoOpen replicates itself into global environment 13 and also copies macros B and C into global environment 13 as well. The text, however, is typically not moved into Global environment 13, because the text is unique to a particular document 11 and therefore is not part of the global environment 13.

Let us assume that AutoOpen has no payload, while macros B and C contain the payload for the macro virus. In step 3, macros B and C manifest their payloads. Step 3 can be precipitated every time a new document 11 is generated by application program 5 or less often, for example, every time document 11 is a letter that is addressed to a certain individual. In any event, the payloads of macros B and C can have a highly negative effect on computer 1. For example, these payloads can infect certain documents 11 with gibberish, reformat a storage medium 9, 10, etc.

Thus does macro virus AutoOpen, B, C infect the global environment 13, and from there is poised like a coiled snake ready to infect other documents 11. This is because the global environment 13 is always active, and thus, macro virus AutoOpen, B. C will always be active. From the newly infected documents 11, this virus Autoopen, B, C can infect the global environments 13 of users to whom the infected documents 11 are passed.

Figure 4:
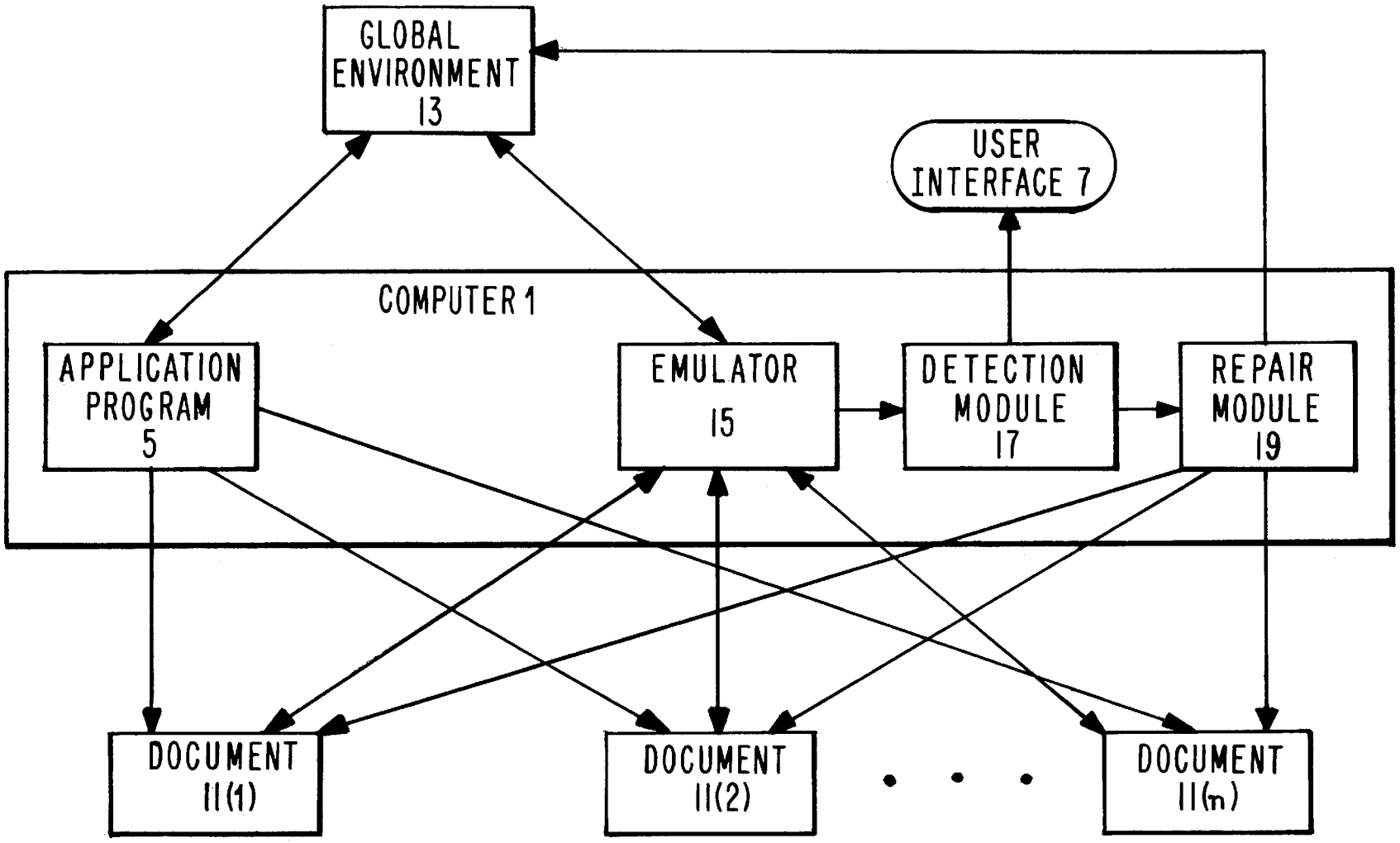
FIG. 4 is a block diagram showing a preferred embodiment of the present invention.

FIG. 4 illustrates apparatus by which the present invention detects and eliminates macro viruses. Emulator 15 is located within computer 1 and executes from within computer 1. Emulator 15 is coupled to the documents 11 generated by application program 5 and to global environment 13. Coupled to emulator 15 is detection module 17, which determines whether a macro virus is present based upon a preselected criterion or preselected criteria. Detection module 17 is coupled to user interface 7, so that it may announce its decisions concerning detection of macro viruses to the user. Coupled to detection module 17 is repair module 19, which eliminates macro viruses that have been determined by detection module 17 to be present. Since these viruses can appear in any document 11 or in the global environment 13, repair module 19 is coupled to all of the documents 11 and to global environment 13.

In general, emulator 15 works by first emulating all of the tested macros assuming that they are located in global environment 13. All copies of macros to a local document 11 are noted. Then emulator 15 emulates the execution of all of the tested macros assuming that they are located in a local document 11. All copies of macros copied to global environment 13 are then noted. The emulation performed in both emulation steps is heuristic in the sense that the emulation is exact only to the point where the necessary parts of the environment are properly emulated. For example, macro viruses depend upon being able to access the file names of documents 11 and the names of macros in order to propagate. On the other hand, macro viruses do not care what the current font is or who manufactured the printer that may be coupled to computer 1. Therefore, in the emulation all language elements of the macro language are implemented as exactly as possible so that the logic of the macro viruses can be properly emulated and thus properly observed. On the other hand, if the macro asks for the font size, it can be fed a dummy number because this is irrelevant to the detection process.

After emulator 15 has performed the emulation steps on all of the macros associated with local documents 11 and global environment 13, detection module 17 flags when a macro virus has been detected. Repair module 19 then accomplishes repair by deleting the set of macro viruses identified by detection module 17.

The emulation steps will now be described in more detail. Each macro's execution entry point is a function written using a structured programming language such as WordBasic (used in Microsoft Word 6.0 and Microsoft Word 95) or Visual Basic (used in conjunction with the Office 97 version of Microsoft Word). A function may itself may call other functions. A structured programming language provides the programmer with features such as named variables and control structures that make the task of writing a program and maintaining it easier than for a nonstructured programming language, such as machine or assembly language. Examples of control structures include decision control structures such as the "if . . . then . . . else . . . end if" construct and the "for . . . next" looping construct. Furthermore, these constructs can be nested within one another. Thus, emulator 15 is programmed to correctly maintain the current state of all constructs that have not yet completed execution. Since emulator 15 emulates a structured programming language, it is more complex than if it were emulating assembly or machine language instructions. However, the methods used for emulating a structured programming language are similar to the methods used for compiling such a program into a set of assembly or machine language instructions. Anyone skilled in the art will thus be already familiar with how this can be done, and therefore the details of how one emulates a program written using a structured programming language are not given herein.

The environment (non language-specific features) provided for the heuristic emulator 15 is what allows the invention to detect viruses in a generic manner. A non language-specific feature is a feature other than a language-specific feature. A language-specific feature is part of the definition of the language itself. In emulator 15, non language-specific features are modified. For example, the macro is tricked into thinking that there are zero macros in a certain location even though there may not be.

As a preliminary step to performing the emulation, the language or languages in which the potential macro viruses have been written must first be determined. Next, the environment is set up for the first emulation step, in which emulation of macros is performed assuming that the macros to be tested are located in the global environment 13, regardless of whether they are located in the global environment 13 or in a local document 11. As part of the environmental set-up, variable data storages and control states are initialized. The main pieces of information from the environment necessary for replication and successful emulation include the count of the number of macros, the names of the macros, and the name of the file containing a given macro. The environment is augmented with any additional information necessary or desirable for viral replication. Providing the environmental information to the heuristically emulated macros involves intercepting the function calls that retrieve this information and then providing the desired information depending upon the context, e.g., whether it is global or local.

During the first emulation step itself, all macros, whether located in a local document 11 or in the global environment 13, are typically emulated in each of the two emulation steps. Emulator 15 identifies a macro as being a macro by known identifiers. As each macro is executed by emulator 15, said macro will request information from the environment, such as how many macros are present in the global environment 13, how many macros are present in each local document 11, etc. The environment is set up so that the information provided to the macros under test is consistent with what a potential virus would actually receive if it were executing in an actual environment. For example, before infecting a local document 11, the virus may iterate through the macros in the local document 11 to see if said document 11 was already infected. To iterate through the macros in the local document 11, the virus needs to retrieve the count of the number of macros in the local document 11 as well as the names of these macros. In a preferred embodiment of this invention, the virus is tricked into attempting to infect the local document 11 by having emulator 15 provide a count of zero macros to the macro under test, regardless of how many macros are actually present in the local document 11. The virus, if present, will then more likely make an attempt to infect the local document 11 by copying its macros to it. This is because there is a greater probability of the virus replicating into the local documents 11 if it thinks that there are no macros in the local documents 11.

During the first emulation step, emulator 15 notes whether a macro copies itself or is copied from the global environment 13 to a local document 11, whether or not the name of the macro has changed during the copy. The names of the macro before and after the copy are also noted by emulator 15. Emulator 15 can detect such copies by examining for commands such as COPY, SELECT ALL TEXT, CUT AND PASTE, etc. Emulator 15 passes information on which macros have been copied to detection module 17.

After execution of the first emulation step, initialization for the second emulation step is performed. In this step, the environment is set up assuming that all of the macros to be tested are located in a local document 11, regardless of whether they are in a local document 11 or are in global environment 13. As before, in a preferred embodiment of the present invention, the macros under test are told that there are zero macros in global environment 13 regardless of the number of macros actually present in global environment 13. As before, this is to trick the macros into propagating, because there is a greater probability of them replicating into the global environment 13 if they think that there are no macros present in global environment 13. During the second emulation step, the macros that copy themselves or are copied are noted by emulator 15, whether or not the name of the macro has charged during the copy. Emulator 15 passes this information to detection module 17.

The operation of detection module 17 will now be described in greater detail. After heuristic emulation of all of the macros (or after examining some subset of the macros), a set of macros that has been copied from global environment 13 to local documents 11, and vice-versa, has been identified by emulator 15. This set of macros is flagged by detection module 17 as containing a macro virus if a preselected detection criterion is satisfied. A typical detection criterion is the detection of a first macro copy operation that has copied a macro from a local document 11 to the global environment 13 and a second macro copy operation that has copied that same macro from the global environment 13 to a local document 11, which can be the same as the original local document 11 or a different local document 11. In other words, a bidirectional macro, as defined above, indicates the presence of a macro virus. The bidirectional macro can be part of the macro virus or be the entire macro virus. This bidirectional macro could have copied itself in both directions, or, alternatively, have been copied in one or more of these directions by another macro or macros. Furthermore, the bidirectional macro could have changed its name as it copied itself, or could have had its name changed as it was copied. When its name so changes, it must change back to the original name when it copies in the second direction in order to meet the definition of being a virus. This is because part of the definition of a virus is that it replicates itself.

Figure 5:
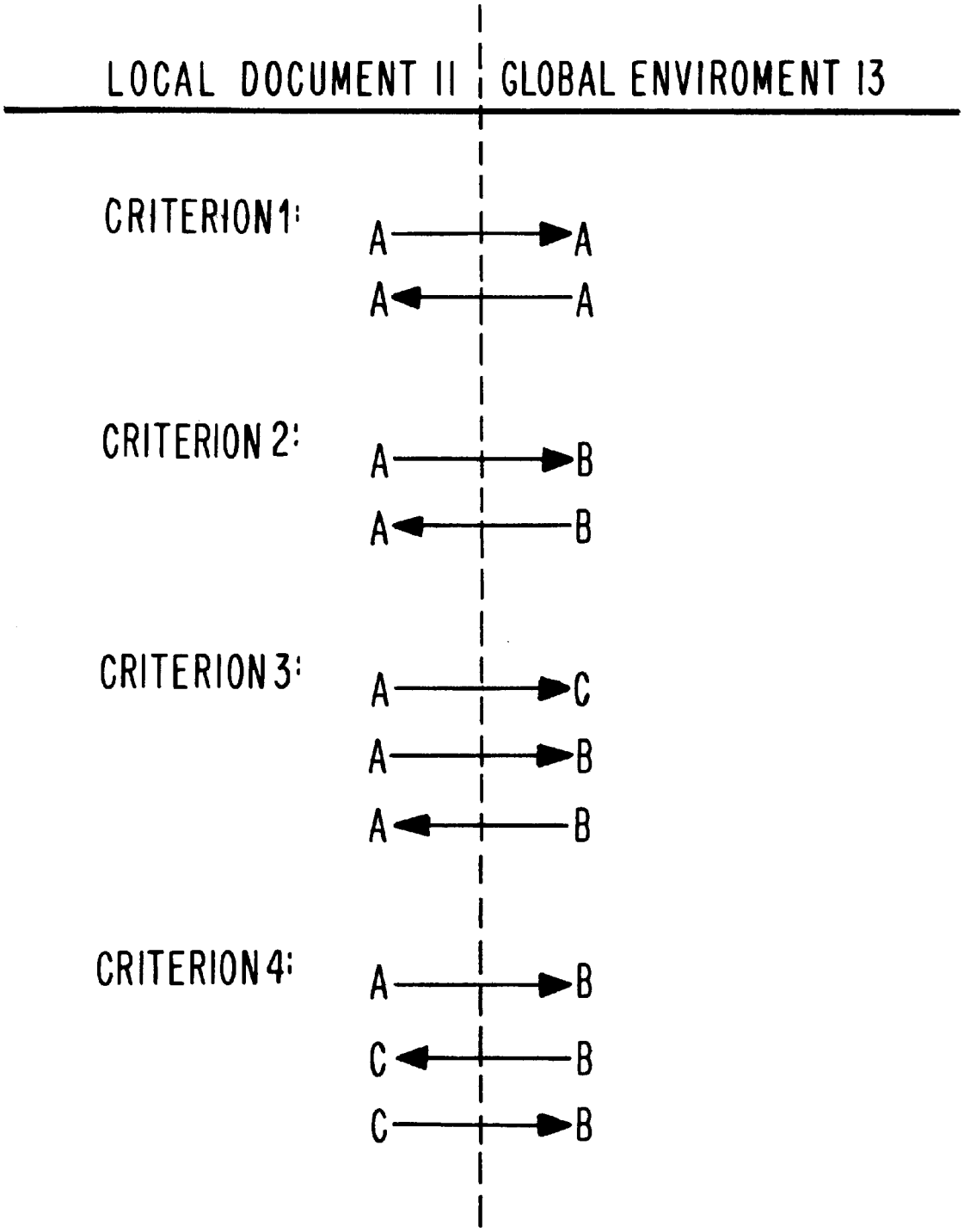
FIG. 5 is a logic diagram showing criteria used by detection module 17 of the present invention in determining whether a macro is deemed to be part of a macro virus or an entire virus.

In preferred embodiments of the present invention, additional deletion criteria are possible. The deletion criteria can be more easily understood by reference to FIG. 5. Criterion 1 illustrated in FIG. 5 shows that macro A is a bidirectional macro of the type that copies or has been copied from a local document 11 to global environment 13 and vice-versa, without changing its name. As discussed above, this is a bidirectional macro of the type that detection module 17 deems to be part of a macro virus or an entire macro virus.

Criterion 2 illustrated in FIG. 5 illustrates a macro A that copies or is copied from a local document 11 into global environment 13 and back to local document 11. However, in the first copy operation, macro A changes its name or has its name changed to macro B; and in the second copy operation, this macro, now denominated as macro B, changes its name or has its name changed back to macro A. As discussed above, despite the name change, this macro is nevertheless of the bidirectional type deemed by detection module 17 to be part of a macro virus or an entire macro virus.

Criterion 3 in FIG. 5 illustrates the case where macro A is a bidirectional macro as described above. Macro A copies from a local document 11 to global environment 13 and back to local document 11. As it does so, the macro changes its name from macro A to macro B, and then back again to macro A. In addition in this example, macro A copies to the global environment 13 as macro C. Thus, macro C is not itself a bidirectional macro as defined above, but it has the same source name (A) as bidirectional macro A, B. This source can be in local document 11, as illustrated in FIG. 5., or in global environment 13. By bidirectional macro A, B, we mean the macro that is named A in one direction and B in the other direction. In this case, in the preferred embodiment, detection module 17 identifies macro C as being part of a virus as well as macro A, B, since macro C is essentially the same as macro A, B but just has a different name.

Criterion 4 in FIG. 5 illustrates the case where macro C, B meets the above definition of a bidirectional macro, since it copies bidirectionally from a local document 11 to global environment 13 and back, changing its name from C to B then back to C. In addition in this example, macro A also copies from local document 11 to global environment 13 where it is renamed macro B. Thus, macro A is a macro that is not itself a bidirectional macro as defined above, but it is a macro having the same destination name (B) as bidirectional macro C, B. This destination can be in the global environment 13, as illustrated in FIG. 5, or in local document 11. In the preferred embodiment, detection module 17 assumes that macro A is also part of a macro virus.

Finally, in a subsequent repair step or steps, repair module 19 deletes all of the macros that have been deemed by detection module 17 to be part of the viral set.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the present invention.

What is claimed is:

1. Apparatus for detecting publicly identified and publicly unidentified macro viruses, said apparatus comprising:

a digital computer having at least one storage device;

an application program associated with said computer;

a global environment associated with said application program;

at least one local document generated by said application program and located within said storage device;

an emulator coupled to said global environment and to said local document(s), said emulator adapted to execute macros contained within said global environment and said local document(s) in a simulated manner; and coupled to said emulator, a detection module adapted to detect the presence of publicly identified and publicly unidentified macro viruses based upon a preselected decision criterion and based upon information provided by said emulator to said detection module.

2. The apparatus of claim 1 further comprising:

coupled to said detection module, a repair module for eliminating macro viruses detected by said detection module.

3. A method for detecting the presence of publicly identified and publicly unidentified macro viruses within a digital computer, said method comprising the steps of:

associating an application program with said digital computer;

associating a global environment with said application program;

causing said application program to generate at least one local document;

emulating the execution of macros contained within said global environment and said local document(s); and applying at least one preselected decision criterion to results of said emulating step to declare when a publicly identified macro virus is deemed to be present and to declare when a publicly unidentified macro virus is deemed to be present.

4. The method of claim 3 further comprising the step of deleting a macro virus when said macro virus is deemed to be present.

5. The method of claim 3 wherein a preselected decision criterion is the presence of a bidirectional macro that propagates, during the emulating step, from a local document to the global environment and from the global environment to a local document.

6. The method of claim 5 further comprising the step of deleting each said bidirectional macro.

7. A method for detecting the presence of macro viruses within a digital computer, said method comprising the steps of:

associating an application program with said digital computer;

associating a global environment with said application program;

causing said application program to generate at least one local document;

emulating the execution of macros contained within said global environment and said local document(s); and applying at least one preselected decision criterion to results of said emulating step to declare when a macro virus is deemed to be present;

wherein a preselected decision criterion is the presence of a bidirectional macro that propagates, during the emulating step, from a local document to the global environment and from the global environment to a local document; and a preselected decision criterion is the presence of a macro having a same source name as any said bidirectional macro.

8. A method for detecting the presence of macro viruses within a digital computer, said method comprising the steps of:

associating an application program with said digital computer;

associating a global environment with said application program;

causing said application program to generate at least one local document;

emulating the execution of macros contained within said global environment and said local document(s); and applying at least one preselected decision criterion to results of said emulating step to declare when a macro virus is deemed to be present;

wherein a preselected decision criterion is the presence of a bidirectional macro that propagates, during the emulating step, from a local document to the global environment and from the global environment to a local document; and a preselected decision criterion is the presence of a macro having a same destination name as any said bidirectional macro.

9. The method of claim 5 wherein a first macro causes the bidirectional macro to propagate from a local document to the global environment, and a second macro distinct from the first macro causes the bidirectional macro to propagate from the global environment to a local document.

10. The method of claim 9 wherein the first macro is the bidirectional macro.

11. The method of claim 9 wherein the second macro is the bidirectional macro.

12. The method of claim 3 wherein the emulating step comprises the substeps of:

performing a first emulation upon at least one test macro assuming that said test macro resides within said global environment, regardless of whether said test macro resides within said global environment or within a local document, while telling said test macro that there are no macros within said local document(s), regardless of whether there are any macros within said local document(s); and performing a second emulation upon at least one test macro assuming that said test macro resides within a local document, regardless of whether said test macro resides within a local document or said global environment, while telling said test macro that there are no macros within said global environment, regardless of whether there are any macros within said global environment.

* * * * *